US006332290B1

(12) United States Patent
Delamare

(10) Patent No.: US 6,332,290 B1
(45) Date of Patent: Dec. 25, 2001

(54) INFLATABLE, DEPLOYABLE, AND COLLAPSIBLE ARCH

(75) Inventor: Guy Robert Delamare, Le Pecq (FR)

(73) Assignee: S.A. Spironef Technologies, Sene (FR)

( * ) Notice: Subject to any disclaimer, the term of this patent is extended or adjusted under 35 U.S.C. 154(b) by 0 days.

(21) Appl. No.: 09/402,198

(22) PCT Filed: Apr. 1, 1998

(86) PCT No.: PCT/FR98/00664

§ 371 Date: Jan. 19, 2000

§ 102(e) Date: Jan. 19, 2000

(87) PCT Pub. No.: WO98/44222

PCT Pub. Date: Oct. 8, 1998

(30) Foreign Application Priority Data

Apr. 2, 1997 (FR) ..... 97 04010

(51) Int. Cl.[7] ..... E04H 15/20

(52) U.S. Cl. ..... 52/2.22; 52/2.24; 52/2.25; 52/2.13; 52/2.17; 52/2.11; 135/124; 135/906

(58) Field of Search ..... 52/2.11, 2.13, 52/2.17, 2.22, 2.23, 2.24, 2.25, 2.26; 135/124, 906

(56) References Cited

U.S. PATENT DOCUMENTS

| | | | | |
|---|---|---|---|---|
| 3,116,746 | * | 1/1964 | Bird | 52/2.23 |
| 3,277,615 | * | 10/1966 | Marquez | 52/2.23 |
| 3,332,176 | * | 7/1967 | Knetzer | 52/2.17 X |
| 3,368,599 | | 2/1968 | Dailey et al. . | |
| 4,976,074 | * | 12/1990 | Delamare | 52/2.23 |
| 5,303,516 | * | 4/1994 | Delamare | 52/2.22 X |
| 5,526,610 | * | 6/1996 | Delamare | 52/2.24 |

FOREIGN PATENT DOCUMENTS

| | | | | |
|---|---|---|---|---|
| 539480 | * | 6/1960 | (BE) | 52/2.23 |
| 1287725 | | 8/1991 | (CA) . | |
| 2724373 | * | 11/1978 | (DE) | 52/2.23 |
| 0 065 240 | | 11/1982 | (EP) . | |
| 0 235 013 | | 9/1987 | (EP) . | |
| 0 312 429 | | 4/1989 | (EP) . | |
| 831738 | | 9/1938 | (FR) . | |
| 1.126.261 | | 11/1956 | (FR) . | |
| 1237283 | * | 6/1960 | (FR) | 52/2.23 |
| 2.070.982 | | 9/1971 | (FR) . | |
| 2 483 489 | | 12/1981 | (FR) . | |
| 975199 | | 11/1964 | (GB) . | |
| 2 177 737 | | 1/1987 | (GB) . | |
| 07-091110 | | 4/1995 | (JP) . | |
| 96/38642 | | 12/1996 | (WO) . | |

* cited by examiner

*Primary Examiner*—Robert Canfield
(74) *Attorney, Agent, or Firm*—Wenderoth, Lind & Ponack, L.L.P.

(57) ABSTRACT

The subject of the invention is a canopy which can be inflated, deployed and retracted, respectively, having a plurality of longitudinal inflatable beams arranged side by side, a device for supplying the inflatable beams with pressurized fluid, and a device for the foundation or ballasting of the canopy. Each of the inflatable beams is formed by a tubular envelope which is closed at its two ends by a mechanical leaktight confinement device.

39 Claims, 15 Drawing Sheets

INFLATABLE, DEPLOYABLE, AND COLLAPSIBLE ARCH

BACKGROUND OF THE INVENTION

1. Field of the Invention

The subject of the present invention is a canopy which can be inflated, deployed and retracted by means of inflation and deflation, respectively.

2. Description of the Related Art

Generally speaking, inflatable canopies comprise a plurality of longitudinal beams placed side by side, means for supplying the inflatable beams with pressurized fluid, at least one path for the deployment or refolding of the said beams, and means for the foundation or ballasting of the said canopy.

This type of canopy is designed, amongst other things, to allow its deployment by simple inflation and its retraction by deflation, which makes it possible, at will, to cover over a space in order to protect it against bad weather and to uncover it in fine weather.

Such a canopy may be used to temporarily cover over large installations such as stadia or spectators' stands.

Canopies of this type are already known, in which each beam is formed by a flexible envelope which incorporates means which ensure the continuity of the leaktightness of the volume it confines and which principally comprises four longitudinal panels whose edges intersect along four longitudinal edges perpendicular to which these panels are not only connected together but also connected to the equivalent panels of the adjacent beams by means of discontinuous mechanical linking means.

However, such a structure poses problems of leaktightness and is complicated owing to the design of each of the inflatable beams.

SUMMARY OF THE INVENTION

The object of the invention is to propose an inflatable canopy which is simple to implement and which makes it possible to avoid the drawbacks mentioned above.

The subject of the invention is thus a canopy which can be inflated, deployed and retracted by inflation and deflation, respectively, of the type comprising:

- a plurality of longitudinal inflatable beams arranged side by side;
- means for supplying the inflatable beams with pressurized fluid; and
- means for the foundation or ballasting of the canopy, characterized in that each of the inflatable beams is formed by a tubular envelope which is closed at its two ends by mechanical leaktight confinement means.

According to other characteristics of the invention:

- the inflatable beams are independent of one another or connected together longitudinally by linking means;
- the inflatable beams are connected, at at least one of their ends, to the foundation or ballasting means by the mechanical leaktight confinement means;
- each tubular envelope is formed by a cylindrical sheath portion made from plastic and produced by extrusion;
- each tubular envelope is produced from a machine width of coated fabric of which warp threads run substantially in the longitudinal direction of this envelope and of which weft threads run substantially in the transverse direction of the envelope; and

- the mechanical leaktight confinement means are formed, in the case of each inflatable beam, by two small bars connected together by at least one fastening element by pinching the corresponding end of the tubular envelope of the beam.

According to further characteristics of the invention:

- the mechanical leaktight confinement means are formed, in the case of all or some of the inflatable beams, by two small bars connected, on the one hand, together by at least one fastening element pinching the corresponding ends of the tubular envelopes of all or some of the beams, and, on the other hand, to the foundation or ballasting means;
- the mechanical leaktight confinement means are formed, in the case of each beam, by a clamp piece which has a central orifice and is connected to the foundation or ballasting means, the clamp piece including a first part fastened to the outer face of the envelope of the corresponding beam and a second part fastened to the inner face of the envelope and connected to the first part by at least one fastening element and the central orifice communicating with the pressurized-fluid-supply means via the foundation or ballasting means;
- the means for linking the inflatable beams together are formed, on the one hand, by a T-shaped section made from flexible material fastened to the envelope of each inflatable beam and including two lateral branches fastened to the envelope and a central branch forming, at its free end, a loop and having uniformly spaced transverse notches to form a series of separate flaps, and, on the other hand, by at least one flexible rod which is intended to be slipped into the loop of one small bar in two of two contiguous sections in order to form at least one hinge; and
- the means for linking the inflatable beams together are formed by a fastening fitting with a central orifice communicating between the inner spaces of the envelopes of two contiguous beams and which includes two parts intended to interact with each other by having a portion of the said envelopes inserted between them.

BRIEF DESCRIPTION OF THE DRAWINGS

The invention will be better understood upon reading the following description which is given purely by way of example and is made with reference to the appended drawings, in which.

DETAILED DESCRIPTION OF THE INVENTION

Figure 1:
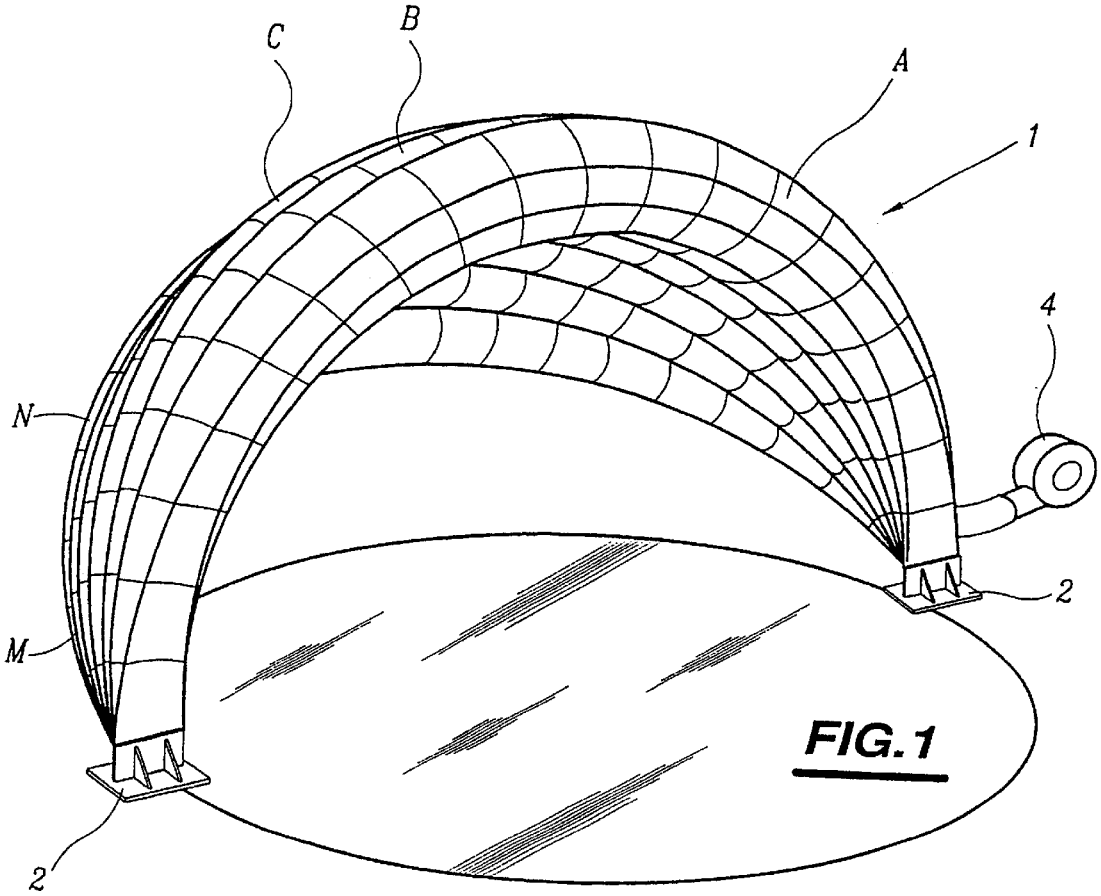
FIG. 1 is a diagrammatic perspective view of a first embodiment of an inflatable canopy according to the invention.
Figure 2:
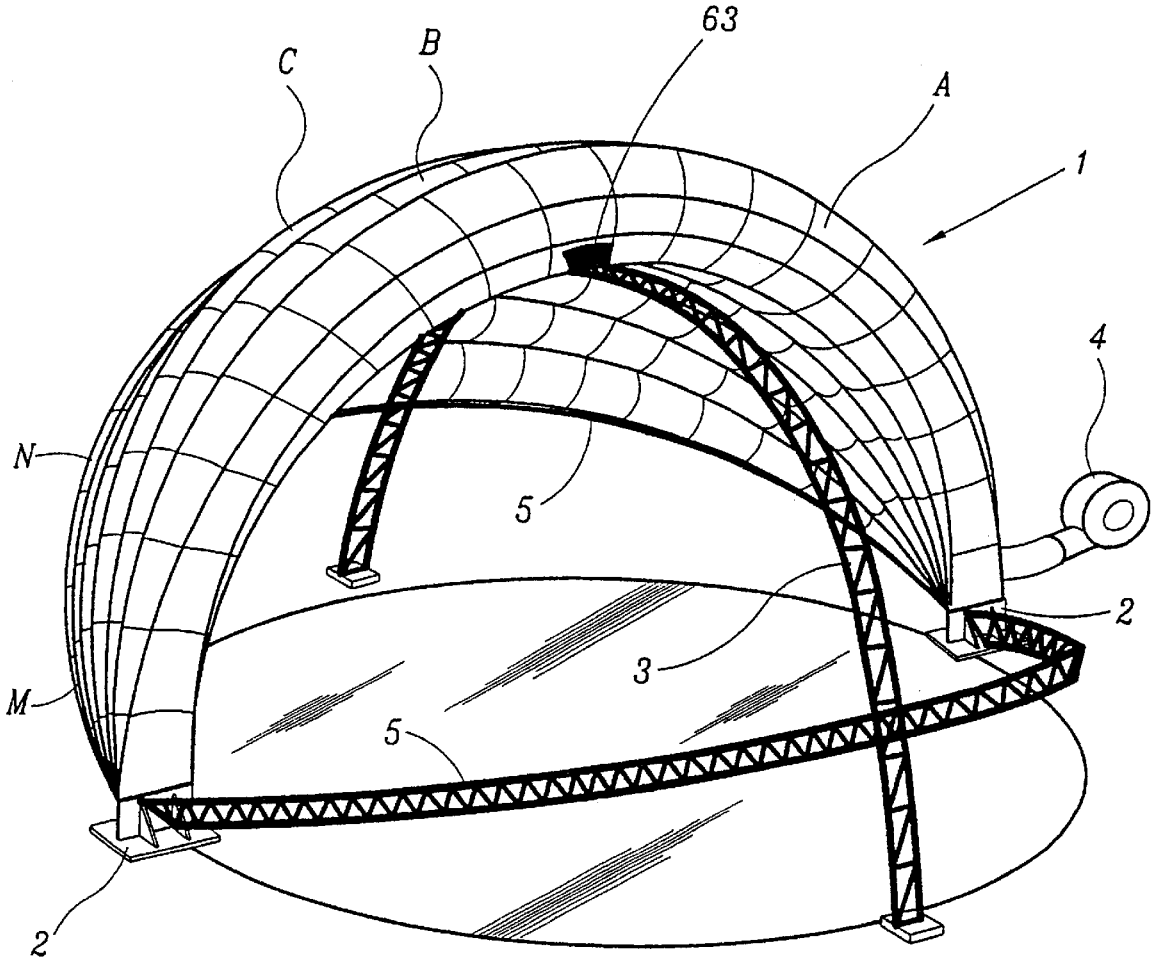
FIG. 2 is a diagrammatic perspective view of a second embodiment of an inflatable canopy according to the invention.

FIGS. 1 and 2 diagrammatically show an inflatable canopy consisting of a plurality of longitudinal inflatable beams A, B, C . . . M, N which are leaktight and arranged side by side in order to form the canopy 1.

The beams A, B, C . . . are independent of one another or are connected together longitudinally by linking means which will be mentioned below.

These beams A, B, C . . . are connected at at least one end to foundation or ballasting means (ballast) 2 fastened to the ground. According to a variant, the inflatable beams may move over at least one deployment or refolding path 3 formed, for example, by a rigid beam (FIG. 2).

Moreover, the inflatable beams A, B, C . . . are connected to means 4 for supplying the inflatable beams with pressurized fluid, which consists, for example, of a pressurized-fluid generator.

According to a variant shown in FIGS. 2, the inflatable canopy 1 also has at least one arch-shaped support 5 extending parallel to the beam with which the support 5 is in contact.

In the embodiment shown in FIG. 2, the canopy 1 has two supports 5 and these supports 5 are arranged at a specific distance from the ground in order to provide openings on either side of the canopy 1.

These supports 5 may also be placed at ground level.

The supports 5 each form a support and a receptacle for the inflatable beams A, B, C . . . and have a triangular cross section, and are formed by a three-dimensional assembly of welded tubes made, for example, from steel.

Each support 5 is connected by caps (not shown in FIG. 2) on the one hand to the deployment or refolding path (deployment/refolding path) 3 and on the other hand to the foundation or ballasting means 2.

Figure 3:
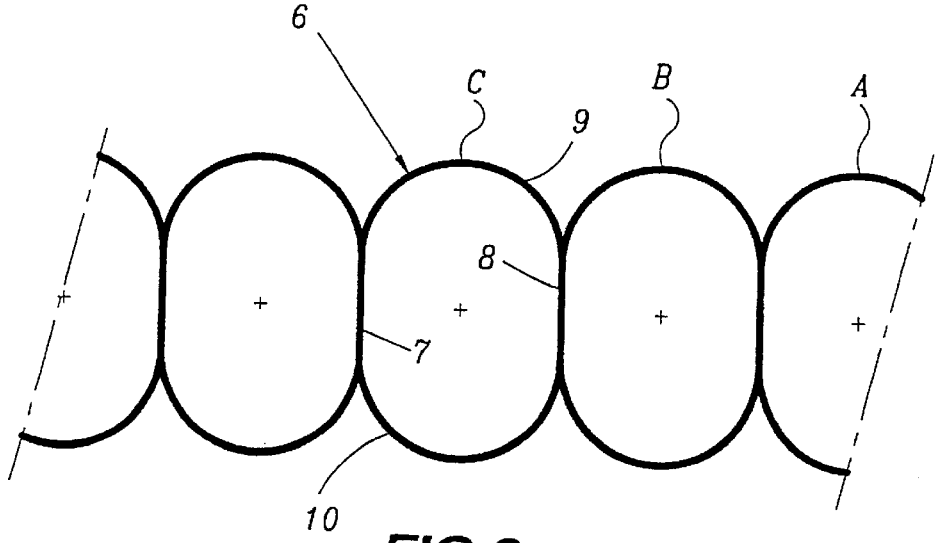
FIG. 3 is a diagrammatic view in transverse section of a portion of the inflatable canopy according to the invention.

As shown in FIG. 3, each beam A, B, C . . . consists of a tubular envelope 6 which guarantees the continuity of the leaktightness of the volume it confines and is composed of four zones of which the two lateral zones form the webs 7 and 8 and of which the two upper and lower zones form an outer flange 9 and an inner flange 10, respectively.

Each tubular envelope 6 consisting of an inflatable beam A, B, C . . . is formed by a cylindrical sheath portion, made from plastic, produced by continuous hot extrusion and extension by internal pressurization at the exit from an annular extrusion die.

According to a variant, each tubular envelope 6 is produced from a machine width of coated fabric of which warp threads run substantially in the longitudinal direction of this envelope 6 and of which weft threads run substantially in the transverse direction of the envelope 6.

Moreover, the inflatable beams of which the canopy 1 consists may be formed by beams of different lengths.

Figure 4:
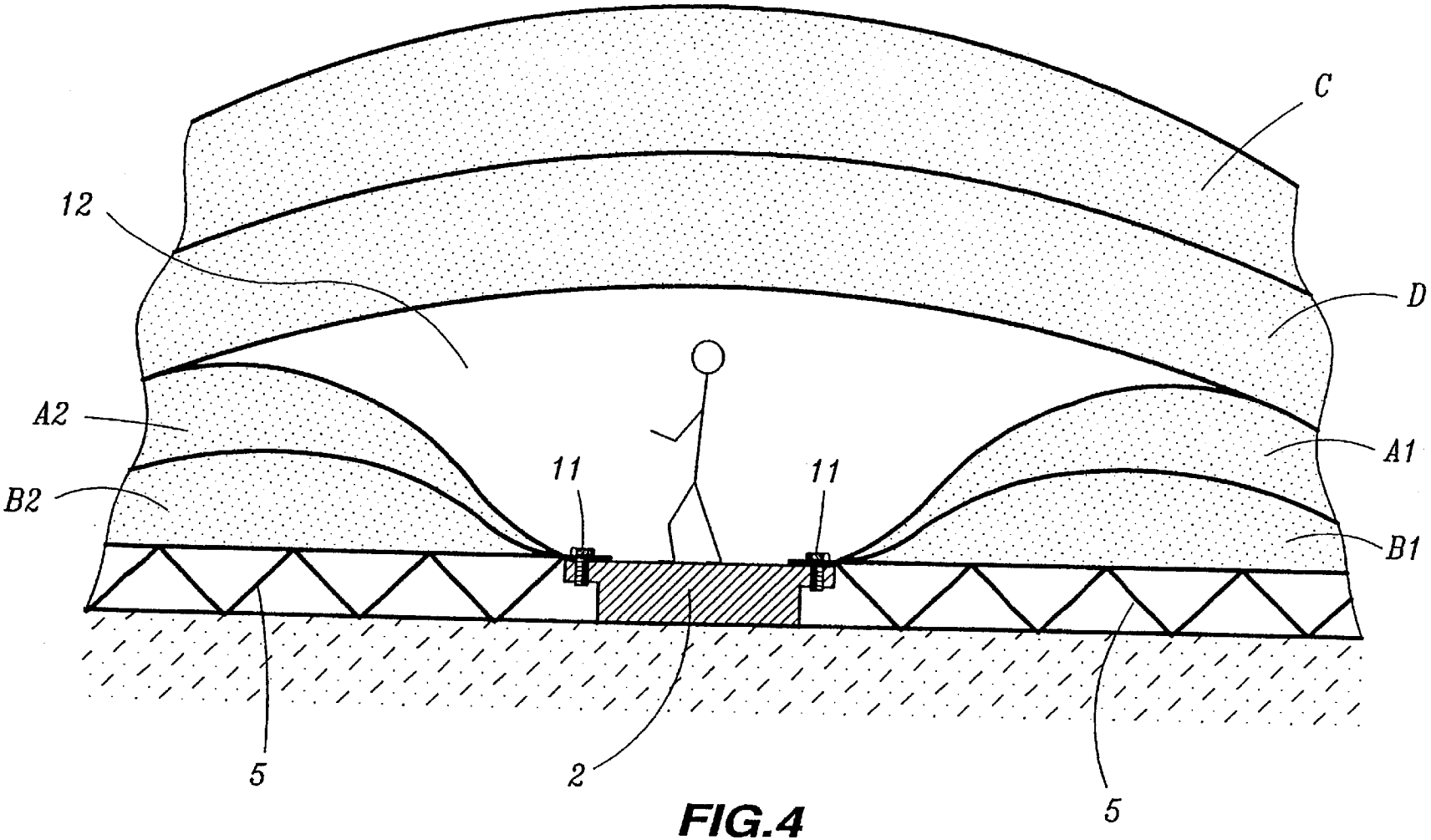
FIG. 4 is a diagrammatic view of a portion of the inflatable canopy, showing a communication opening.

According to a particular embodiment shown in FIG. 4, the canopy 1 is formed from beams C, D . . . of great length and from beams A1, B1; A2, B2 . . . of shorter length.

The ends of the beams, A1, B1; A2, B2 . . . are connected by fastening members 11 in order, after inflation of the beams, to form at least one opening 12 for communication or access between the inside and the outside of the inflatable canopy 1.

Figure 5:
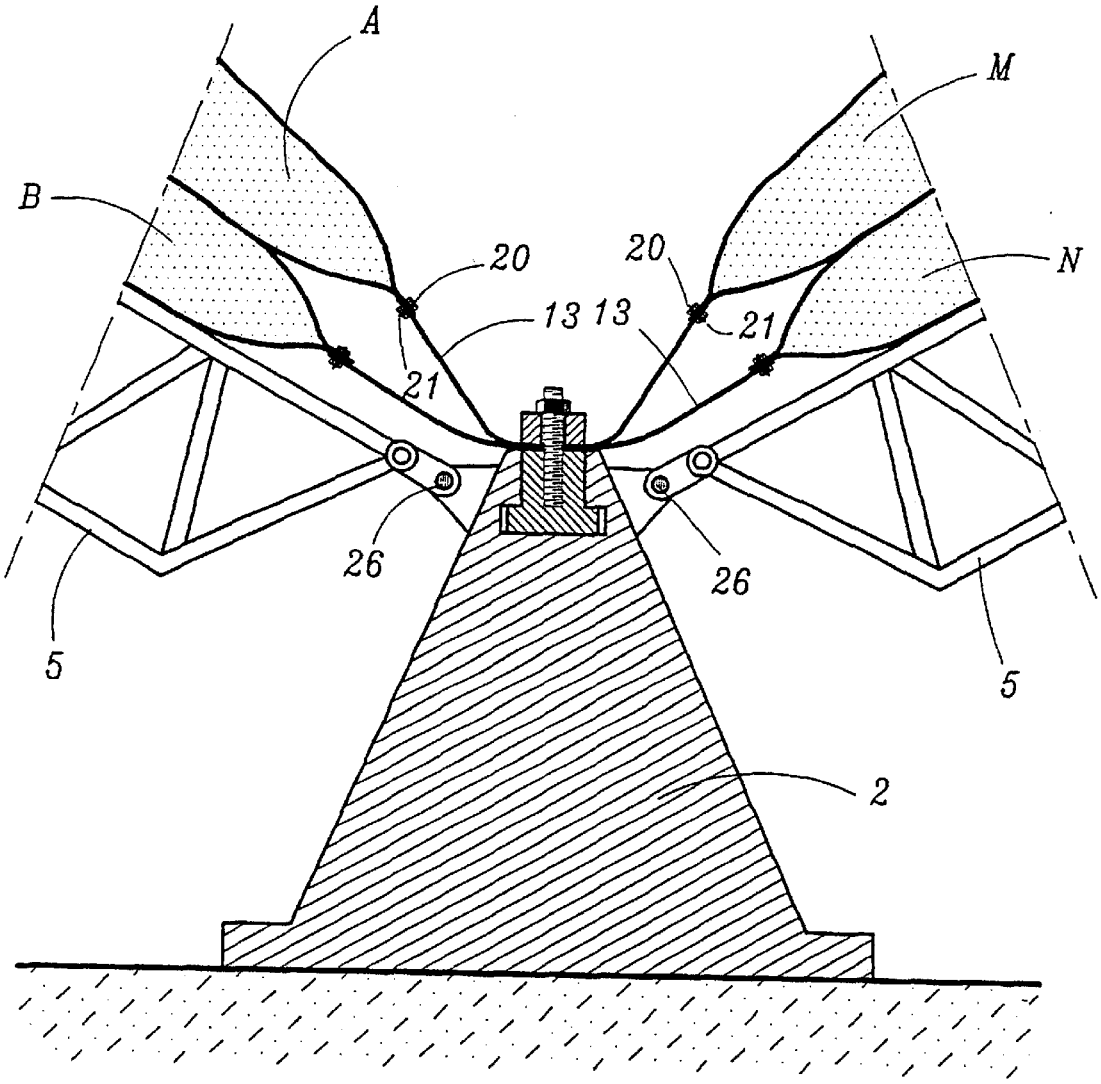
FIG. 5 is a diagrammatic view of one end of a part of the inflatable beams of the canopy connected to the foundation or ballasting means.

All or some of the inflatable beams A, B, C . . . are connected to the foundation or ballasting means 2 by at least one strap 13 extending the corresponding beam and fastened to it at the location of the mechanical leaktight confinement means (mechanical leaktight confinement device), as shown in FIG. 5.

Figure 6:
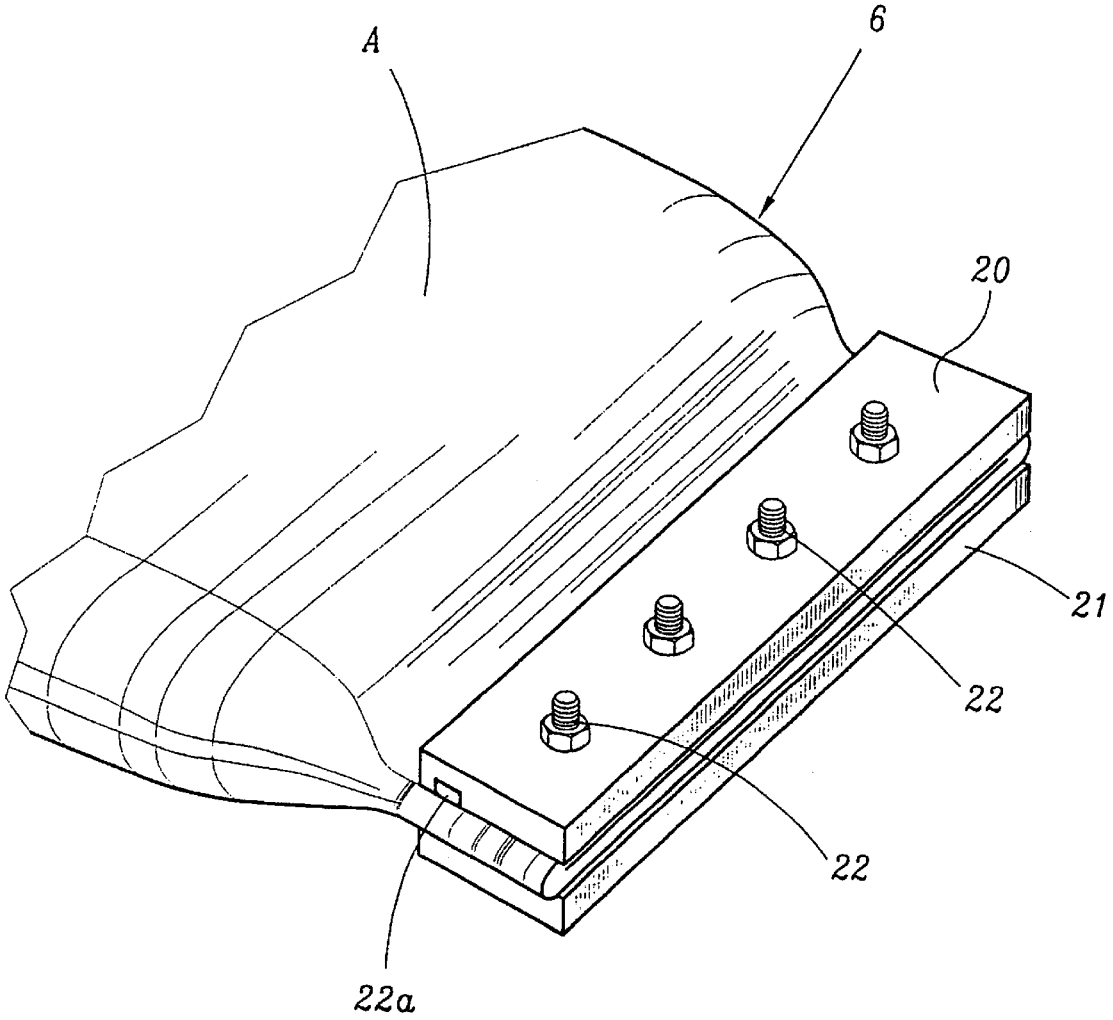
FIG. 6 is a diagrammatic perspective view of a first embodiment of the mechanical leaktight means for confining an inflatable beam.
Figure 7:
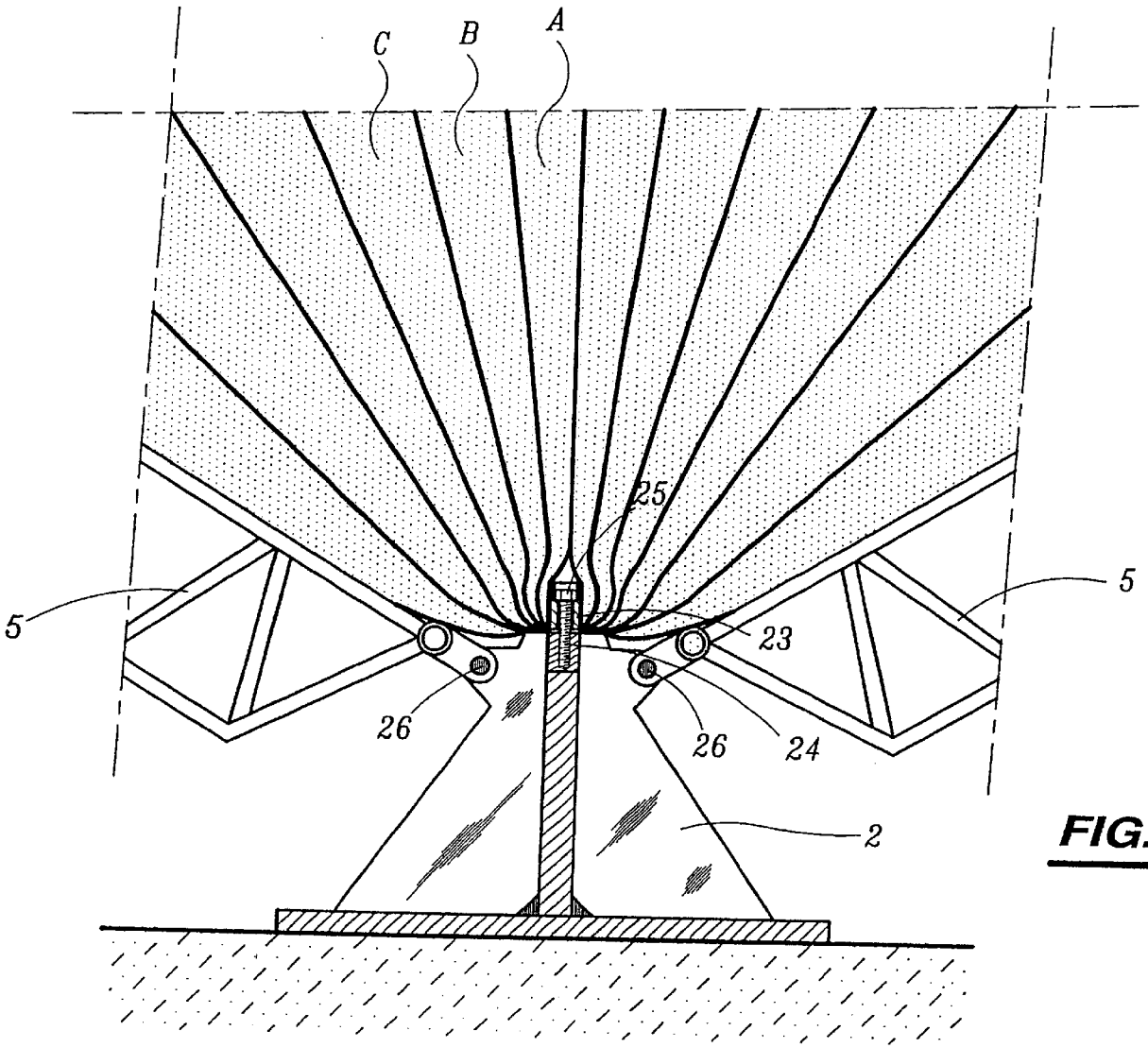
FIG. 7 is a diagrammatic view in transverse section of a second embodiment of the mechanical leaktight means for confining the inflatable beams.

With reference, now, to FIGS. 6 and 7, a description will be given of two embodiments of the mechanical leaktight means for confining the inflatable beams A, B, C . . . .

According to a first embodiment shown in FIG. 6, these mechanical leaktight confinement means are formed, in the case of each inflatable beam A, B, C . . . , by two small bars 20 and 21, respectively, connected together by fastening elements 22 such as, for example, bolts, pinching the corresponding end of the tubular envelope 6 of the said inflatable beam A, B, C . . . with a seal 22*a* being placed in between.

According, to a second embodiment shown in FIG. 7, the mechanical leaktight confinement means are formed, in the case of all or some of the inflatable beams A, B, C . . , by two small bars 23 and 24, respectively, connected, on the one hand, together by at least one fastening element 25 consisting, for example of a screw, pinching the ends of the tubular envelopes 6 of all or some of the inflatable beams, and, on the other hand, to the foundation or ballasting means 2.

As may be seen in FIGS. 5 and 7, the supports 5 have their ends articulated via a common axis with the aid of caps 26 connected to the foundation or ballasting means 2.

Figure 8:
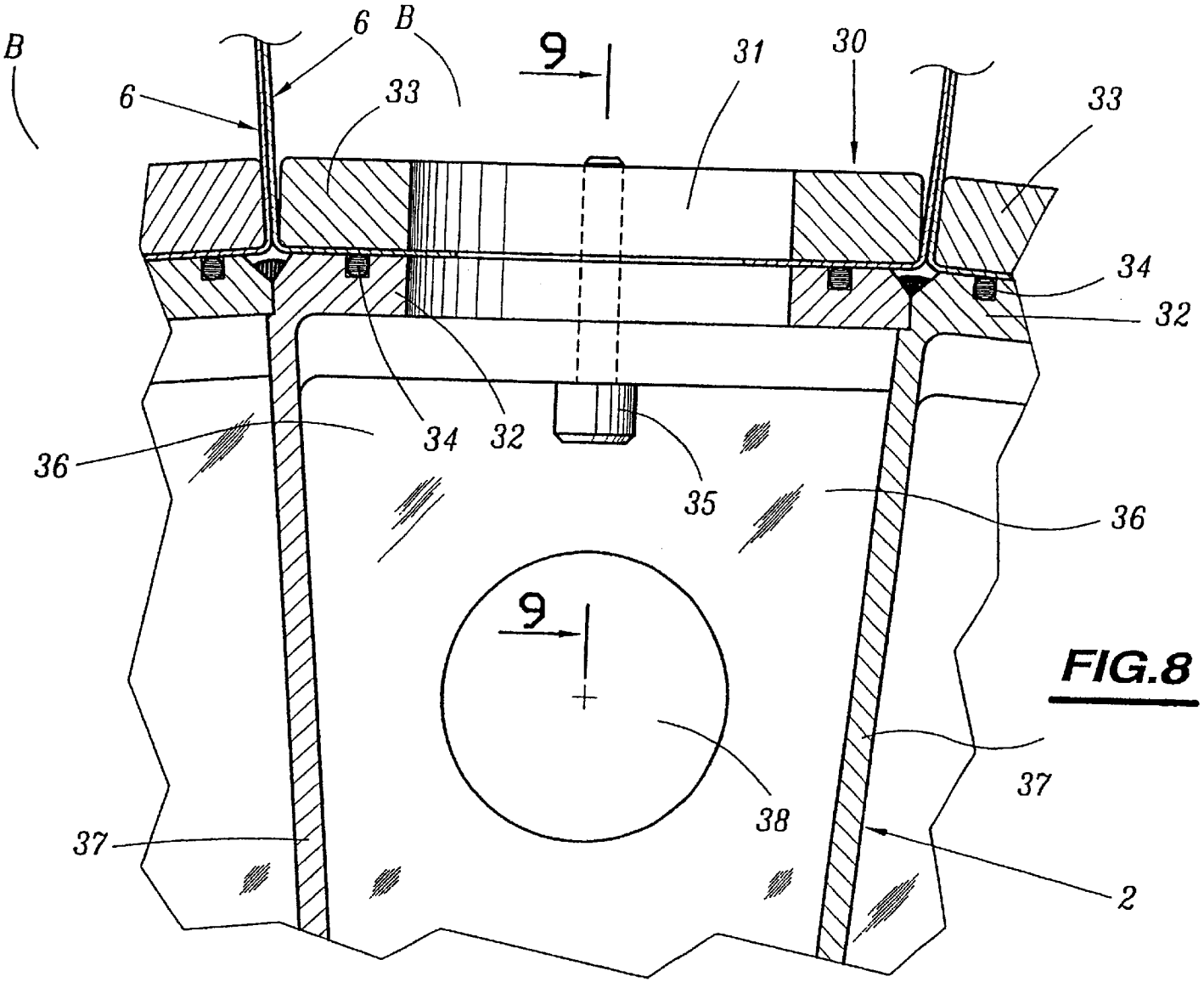
FIG. 8 is a diagrammatic view in transverse section of a first embodiment of the foundation and ballasting means.
Figure 9:
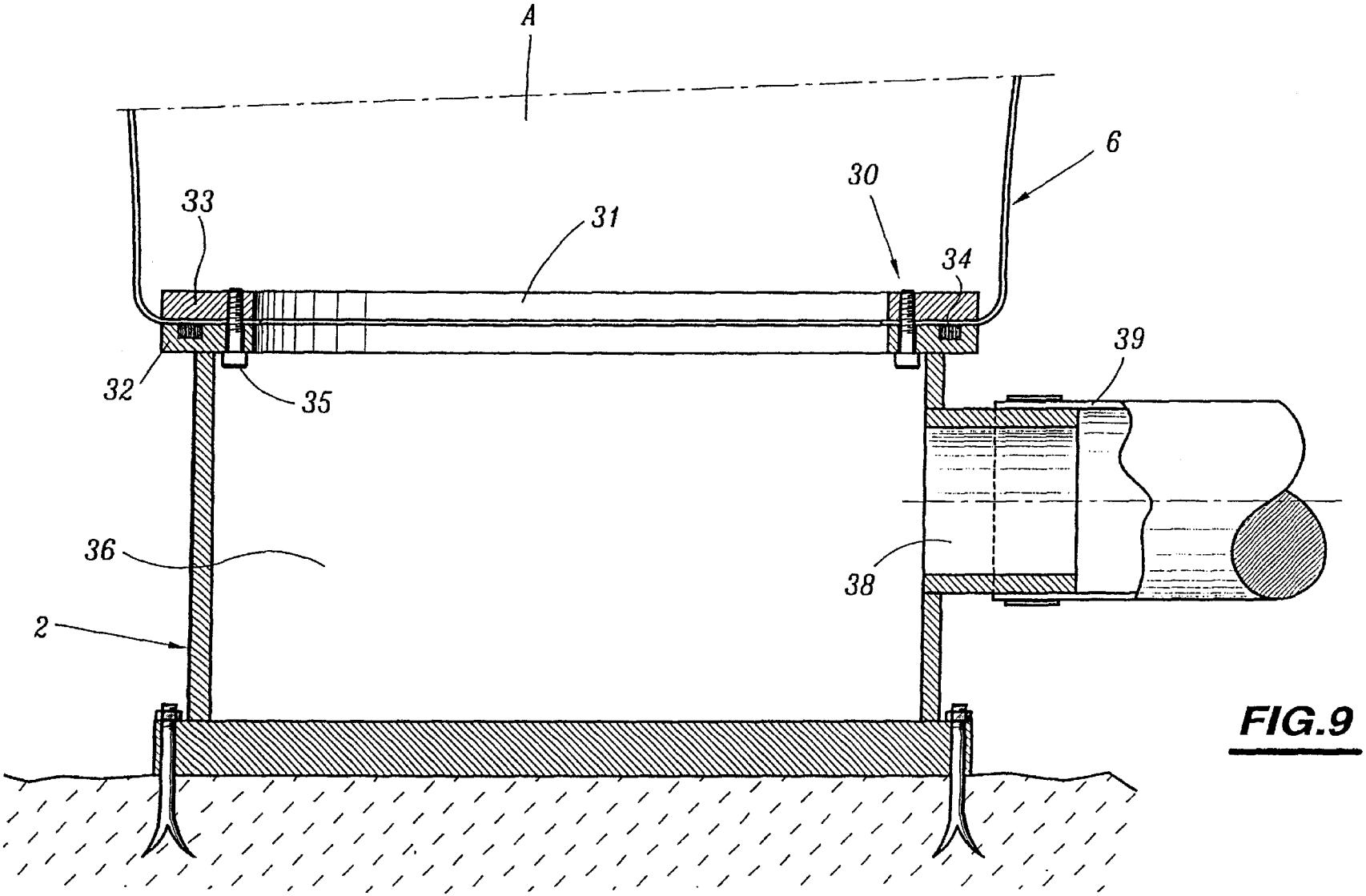
FIG. 9 is a sectional view along the line 9—9 in FIG. 8.

According to a further embodiment shown in FIGS. 8 and 9, the mechanical leaktight confinement means of each inflatable beam A, B, C . . . are formed in the case of each of these inflatable beams, by a clamp piece 30 which has a central orifice 31 and is connected to the foundation or ballasting means 2.

Each clamp piece 30 has a first part 32 fastened to the outer face of the envelope 6 of the corresponding beam A, B, C and a second part 33 fastened to inner face of the envelope 6.

The ends of the envelope 6 of the corresponding beam A, B, C . . . are pinched between the two parts 32 and 33 of the clamp piece 30 and a seal 34 is placed between these parts.

The two parts 32 and 33 of the clamp piece 30 are connected together by at least one fastening element 35 and the central orifice 31 of each clamp piece 30 communicates with the pressurized-fluid-supply means 4 via the foundation and ballasting means 2.

According to an embodiment shown in FIG. 8, the foundation or ballasting means 2 are formed by a caisson divided by vertical partitions 37 into compartments 36 which each communicate with an inflatable beam A, B, C . . . via a central orifice 31 and with the pressurized-fluid-supply means 4.

To this end, each compartment 36 has a lateral orifice 38 connected via a hose 39 to selective pressurized-fluid-distribution means (not shown) which are themselves connected to the means 4 for supplying the inflatable beams A, B, C . . . with pressurized fluid.

Figure 10:
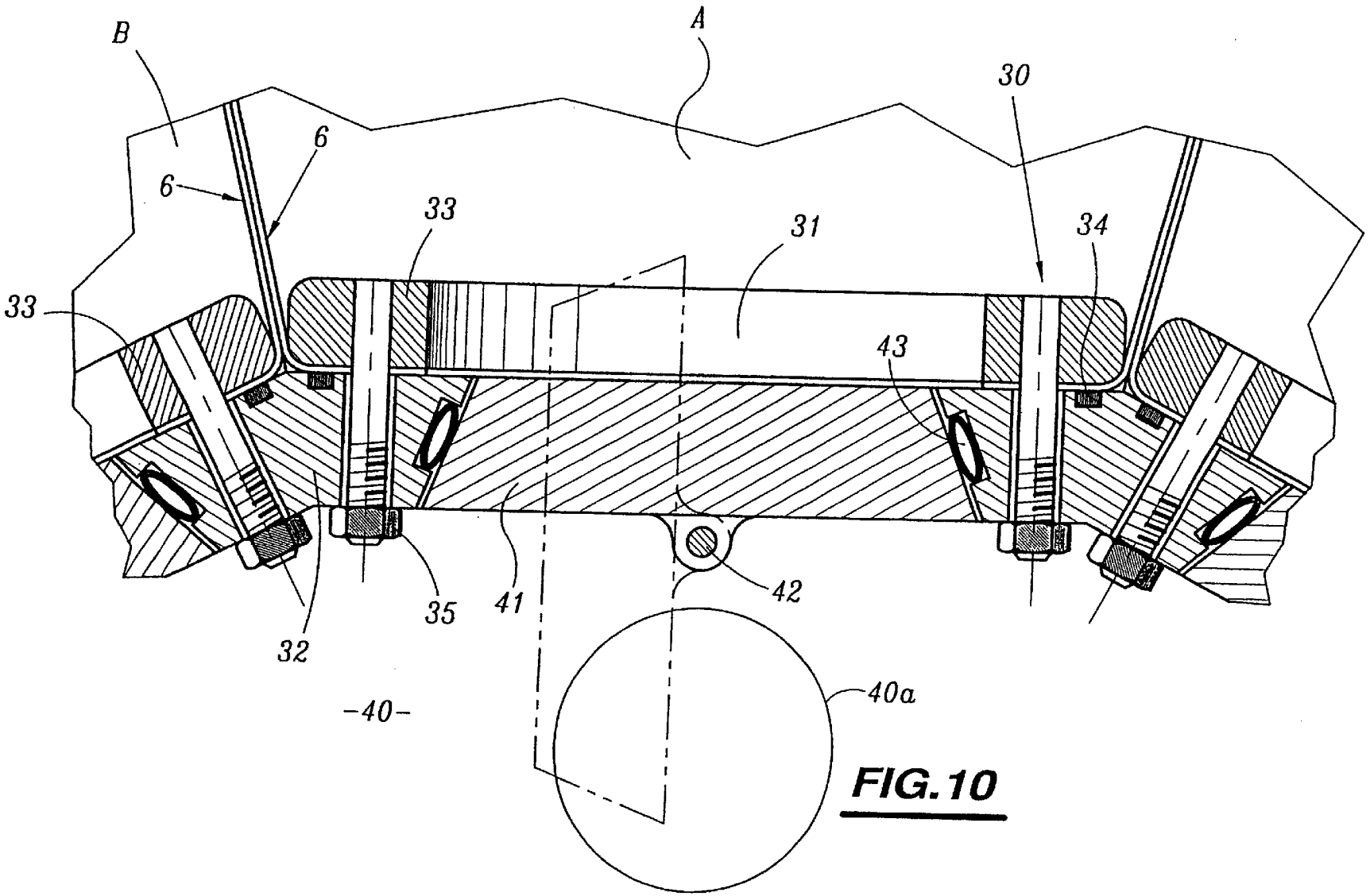
FIG. 10 is a diagrammatic view in transverse section of a second embodiment of the foundation or ballasting means.

According to a further embodiment shown in FIG. 10, the foundation or ballasting means 2 include, in particular, a caisson 40 which communicates with the inflatable beams A, B, C . . . via the central orifice 31 in each clamp piece 30 and with the pressurized-fluid-supply means 4 via a lateral orifice 40*a*.

In this embodiment, each central orifice 31 has a closing-off member which can be moved between a position, shown in broken lines in FIG. 10 in which the central orifice 31 is open and a position, shown in solid lines in that figure, in which the central orifice 31 is closed.

Each closing-off member is formed by a butterfly nut 41 rotating about a shaft 42 and which has, at its periphery, an inflatable seal 43 intended to interact with the edge of the central orifice 31 when the butterfly nut 41 is in the closing-off position.

This seal 43 is inflated in order to obtain a perfect seal when the butterfly nut 41 is in the closed position and deflated in order to allow the opening maneuver via a one-quarter rotation of this butterfly nut 41.

The flow of pressurized fluid may therefore be regulated by positioning the butterfly nut 41 in an intermediate position.

Figure 11:
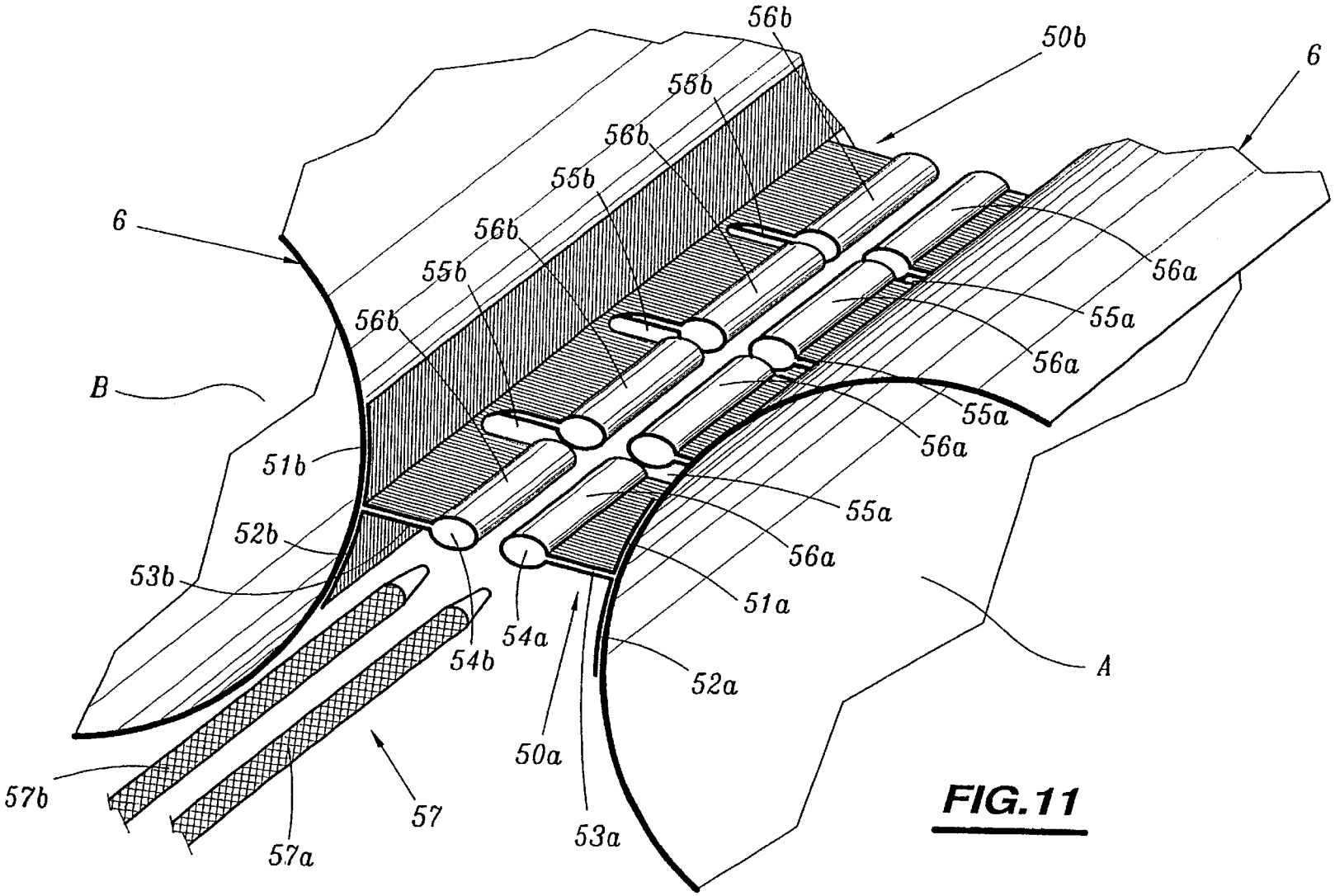
FIG. 11 is a diagrammatic perspective view of a first embodiment of the means for linking the inflatable beams together.
Figure 12:
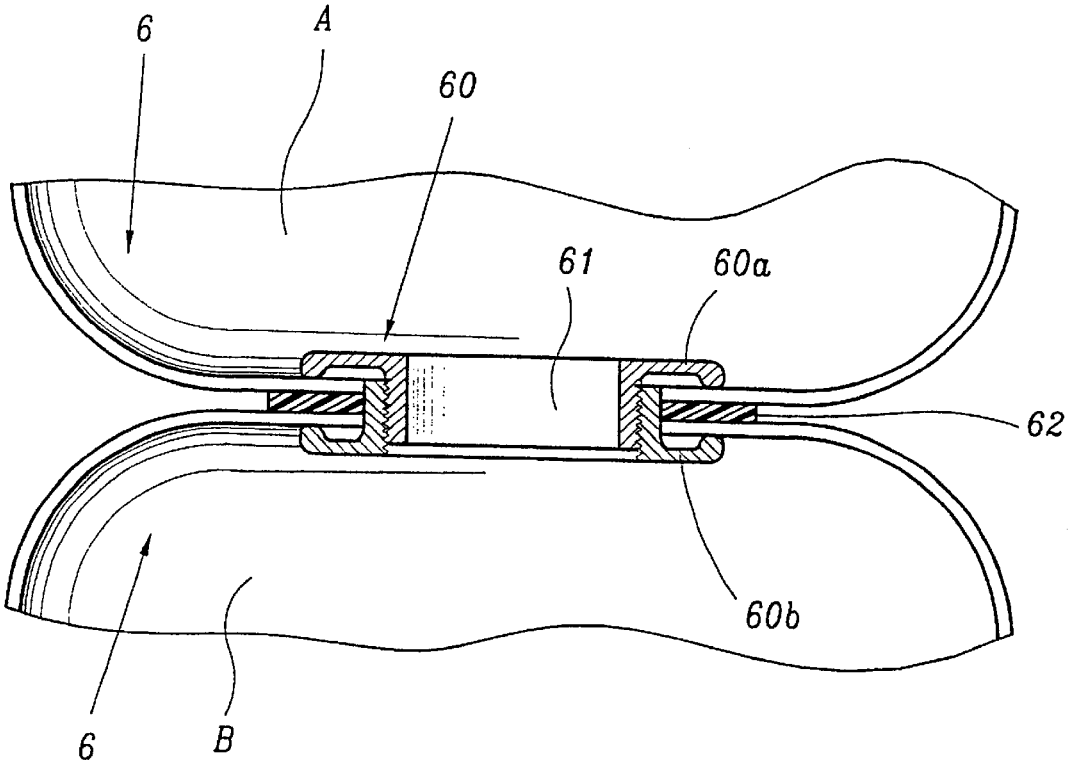
FIG. 12 is a diagrammatic view in transverse section of a second embodiment of the means for linking the inflatable beams together.

With reference, now, to FIGS. 11 and 12, a description will be given of the means for linking the inflatable beams A, B, C . . . together (i.e., linking device).

The means for linking the inflatable beams A, B, C . . . together are located substantially halfway up the radial sections of the envelopes 6 of the inflatable beams.

FIG. 11 shows a first embodiment of these means for linking two adjacent inflatable beams A and B, the means for linking the other inflatable beams being identical.

As shown in this figure, the linking means are formed by a first T-shaped section 50*a* made from flexible material, fastened to the envelope 6 of the inflatable beam A, and by a second T-shaped section 50*b* fastened to the envelope 6 of the inflatable beam B, opposite the first section 50*a*.

The first section 50*a* has two lateral branches 51*a* and 52*a* fastened, for example, by gluing to the envelope 6 of the inflatable beam A and a central branch 53*a* forming a loop 54*a* at its free end.

The central branch 53*a* has uniformly spaced transverse notches 55*a* in order to form a series of separate flaps 56*a*.

Similarly, the T-shaped section 50*b* has two lateral branches 51*b* and 52*b* fastened, for example, by gluing to the envelope 6 of the inflatable beam B and a central branch 53*b* forming a loop 54*b* at its free end.

The central branch 53*b* has uniformly spaced transverse notches 55*b* in order to form a series of separate flaps 56*b*.

The linking means also comprise at least one flexible rod 57 intended to be slipped into the loop 54*a* or 54*b* of one of the flaps 56*a* or 56*b* in alternating fashion.

In the illustrative embodiment shown in FIG. 11, two rods 57*a* and 57*b*, respectively, are provided.

Therefore, the first rod 57*a* is slipped into the loop 54*a* of the first flap 56*a* then into the loop 54*b* of the second flap 56*b* and so on, and the second rod 57*b* is slipped into the loop 54*b* of the first flap 56*b*, then into the loop 54*a* of the second flap 56*a* and so on in order to form at least one hinge.

According to a second embodiment shown in FIG. 12, the means for linking the inflatable beams A, B, C . . . together are formed by a fastening fitting 60 which has a central orifice 61 communicating between the inner spaces of the envelopes 6 of two contiguous beams A, B, C . . . .

Each fastening fitting 60 is formed of two parts 60*a* and 60*b*, respectively, intended to interact with each other, for example by screwing, a portion of the envelope, 6 of the contiguous beams A, B, C . . . being inserted between them.

As shown in FIG. 12, a seal 62 is placed between the outer faces of the envelopes 6 of the contiguous beams A, B, C . . . .

The deployment or refolding path 3 of the inflatable beams A, B, C . . . is formed by at least one rigid beam located substantially in the central zone of the inflatable beams A, B, C . . . .

The rigid beam 3 has a triangular cross section and is formed by a three-dimensional assembly of welded tubes.

Figure 14:
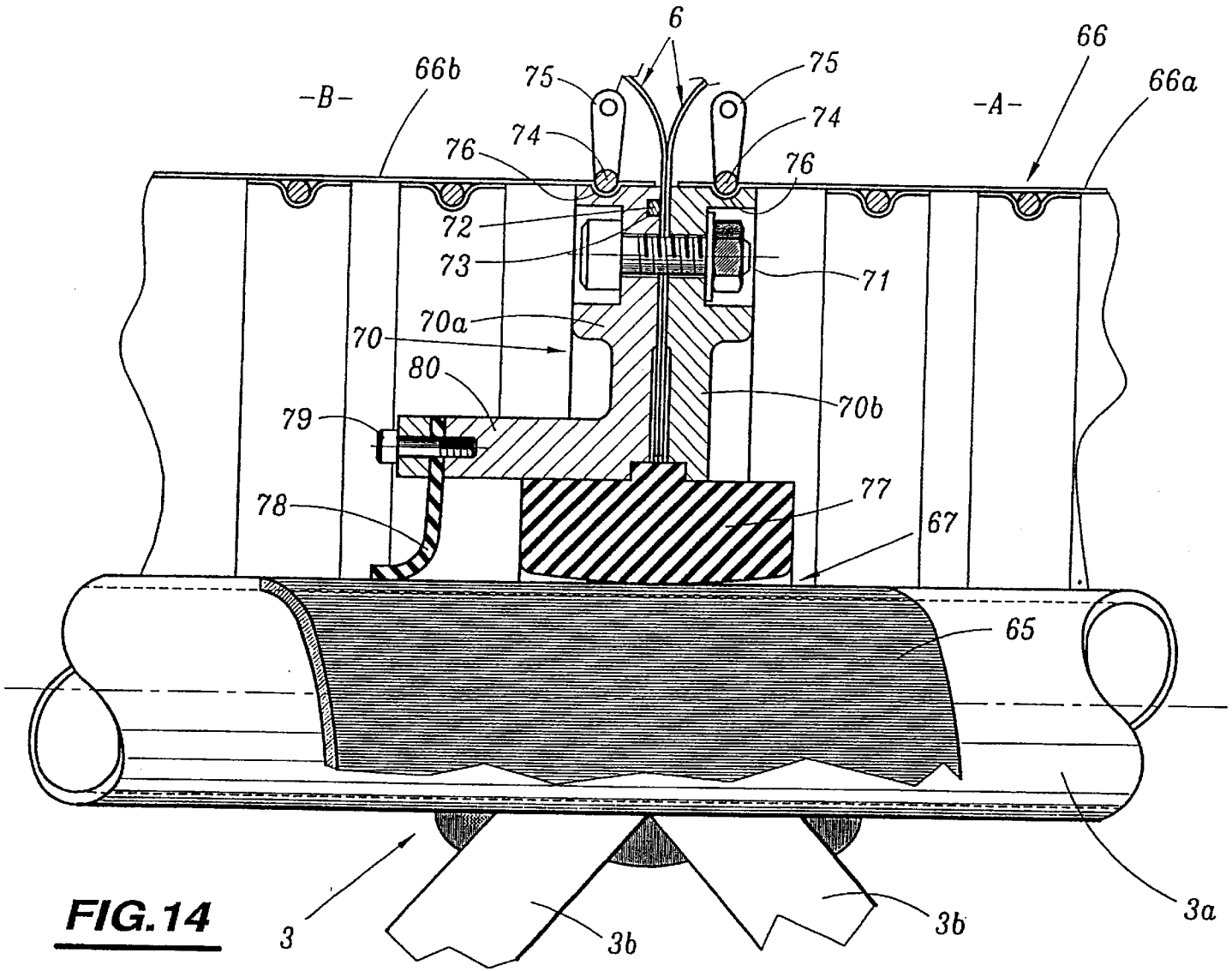
FIG. 14 is a diagrammatic view in transverse section of the linking and leaktight means of the inflatable canopy shown in FIG. 13, with a deployment or refolding path.

As shown in FIG. 14, each rigid beam 3 is formed from longitudinal booms 3*a* which are, for example, three in number, and of transverse booms 3*b* connecting the said longitudinal booms 3*a* together.

Figure 13:
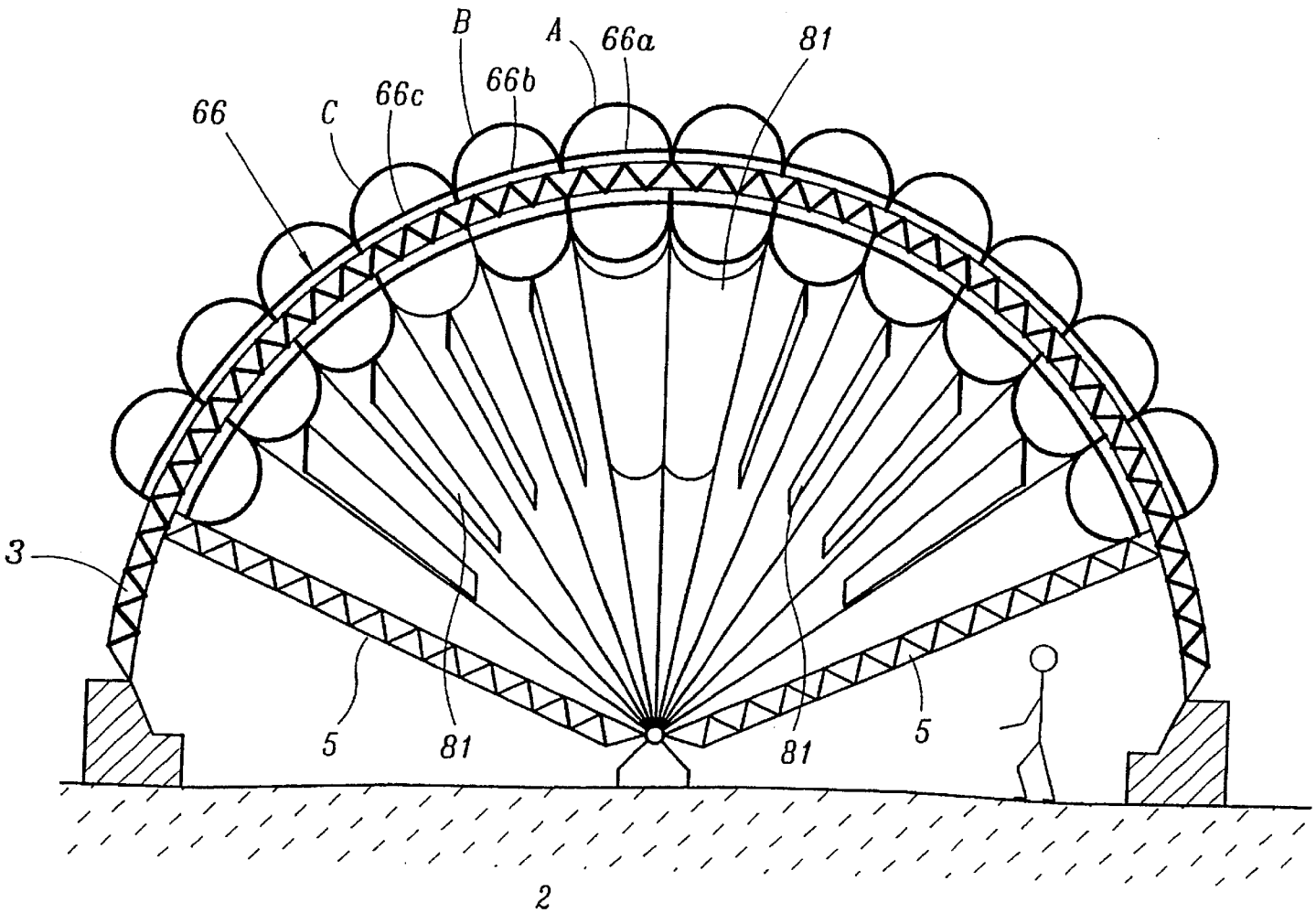
FIG. 13 is a diagrammatic view in transverse section of a variant of an inflatable canopy according to the invention.
Figure 16:
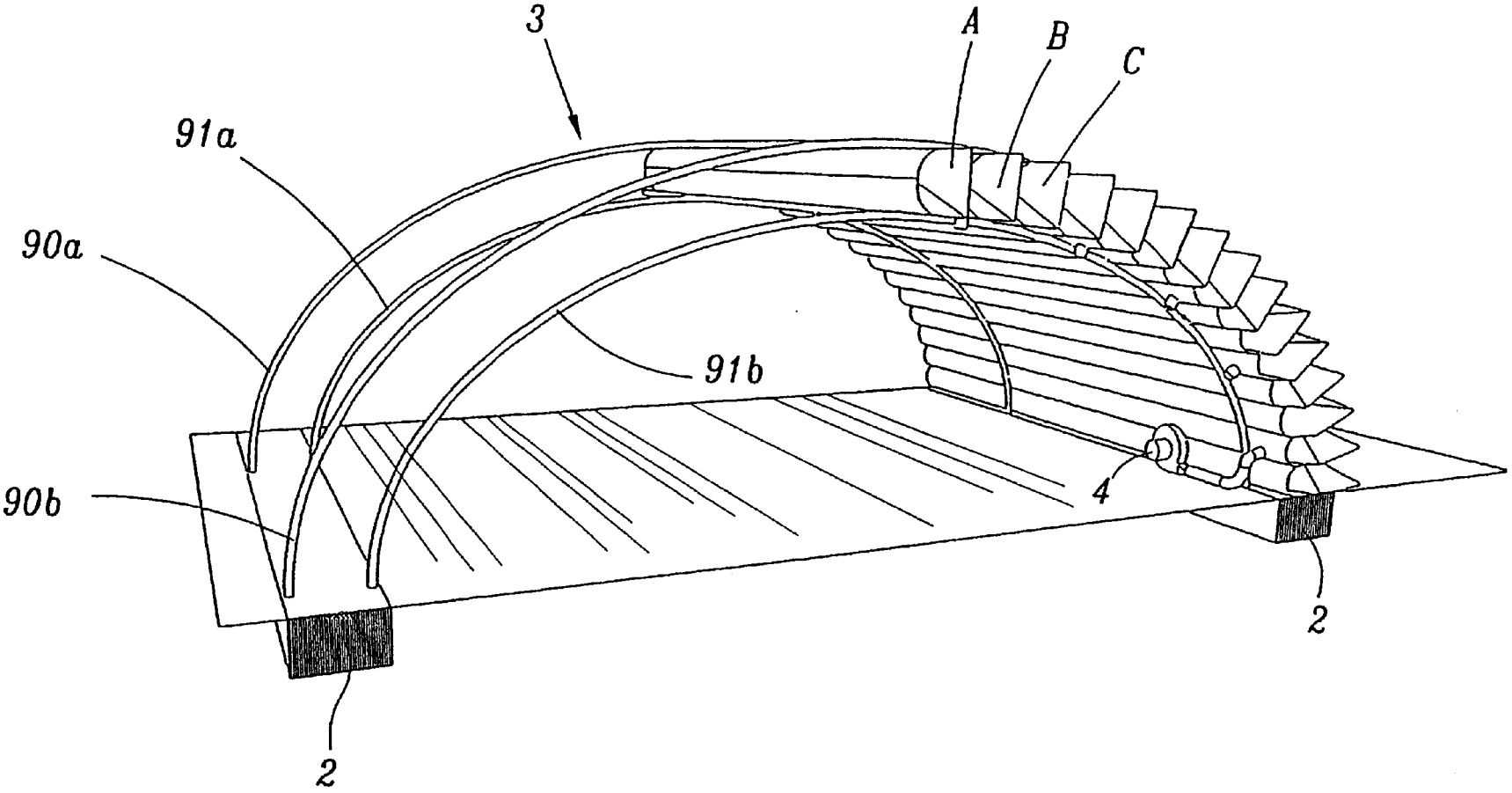
FIG. 16 is a diagrammatic perspective view of a further variant of an inflatable canopy according to the invention.

The rigid beam 3 is placed outside the inflatable beams A, B, C . . . , as shown in FIGS. 2 and 16 or passes through the inflatable beams A, B, C . . . in a leaktight manner, as shown in FIGS. 13 and 14.

If the rigid beam 3 forming the deployment or refolding path is placed outside the inflatable beams A, B, C . . . , the outer flange 9 or the inner flange 10 of the inflatable beams has, at the point of contact with the rigid beam 3, a pad 63 glued to the outer flange 9 or the said inner flange 10 of each inflatable beam A, B, C . . . .

These pads 63 form sliding and wear-reinforcement zones which enter into frictional contact on at least one longitudinal boom 3*a* of the rigid beam 3 during deployment or refolding of the inflatable canopy 1.

If the rigid beam 3 passes through the said inflatable beams A, B, C . . . in a leaktight manner, the rigid beam 3 of triangular cross section may be streamlined by a plurality of curved panels 65 fastened to the longitudinal booms 3*a* of the rigid beam 3 in order to form a rigid beam of circular cross section, as shown in FIG. 14.

The rigid beam 3 passes through the inflatable beams A, B, C . . . in a leaktight manner by means of a flexible conduit 66, which can be flattened, formed from several portions 66*a*, 66*b*, 66*c* . . . (FIG. 13) each of which connect two opposite orifices 67 in the envelope 6 of the inflatable beams A, B, C . . . (FIG. 14).

As shown in this figure, the edge of each orifice 67 includes means for leaktight linking (linking device) with, on the one hand, the envelope 6 of the corresponding inflatable beam, and, on the other hand, the envelope 6 of the adjacent inflatable beam, means for leaktight linking (conduit linking device) with the conduit 66, means for guiding (guiding device) on the rigid beam 3, and means for maintaining the leaktightness (inner sealing device) of the inner space of the flexible conduit 66 during deployment or refolding of the inflatable beams A, B, C . . . .

As shown in FIG. 14, the means for leaktight linking between the envelopes 6 of two adjacent inflatable beams A and B are formed by a clamp piece 70 which has two parts 70*a* and 70*b*, respectively, fastened together by means of a plurality of fastening elements 71 such as, for example, bolts, pinching the ends of the envelopes 6 with an O-ring 72 being placed in an annular groove 73 in the first part 70*a* of the clamp piece 70.

The means for leaktight linking between the edge of each orifice 67 and the corresponding portion of the conduit 66 comprise a collar 74 consisting of an open ring made, for example, from round wire, ending in a tab 75 at each of its ends.

These tabs 75 may be distanced from or brought closer to each other by means of a fastening element (not shown) allowing the gripping of the flexible wall of the corresponding portion, for example 66*a*, inside an annular groove 76 on the peripheral face of the clamp piece 70.

The means for guiding on the rigid beam 3 of the inflatable beams A, B, C . . . during deployment or refolding of the inflatable canopy 1 are formed, in the case of each orifice 67, by a sliding ring 77 secured to the edge of the orifice 67.

According to an embodiment shown in FIG. 14, the sliding ring 77 is placed on the inner wall of the clamp piece 70 and this sliding ring 77 is intended to enter into frictional contact on the rigid beam 3 during deployment or refolding of the inflatable beams A, B, C . . . .

The means for maintaining the leaktightness of the inner space of the flexible conduit 66 at each orifice 67 are formed by an annular seal 78 secured to the edge of this orifice 67.

In the illustrative embodiment shown in FIG. 14, this annular seal 78 is fastened by fastening elements 79 to a ring 80 secured to the first part 70*a* of the clamp piece 70.

This annular seal 78 enters into frictional contact on the curved panels 65 of the rigid beam 3 during deployment or refolding of the inflatable beams A, B, C . . . .

As shown in FIG. 13, some or all of the inflatable beams A, B, C . . . include, on their inner flange 10, a flap 81 made, for example, from appropriate fabric, and which hangs freely as a curtain or festoon inside the inflatable canopy 1 to modify the acoustic qualities of the inner space covered by the said inflatable canopy 1.

The inflatable canopy 1 is assembled as follows.

Firstly, on the ground, the supports 5 are assembled and the deployment or refolding path 3 is fitted.

Next, above these supports 5, the inflatable beams A, B, C . . . are installed, deflated and superimposed one upon another.

These inflatable beams A, B, C . . . are connected at their ends to the foundation or ballasting means 2.

Then, all the inflatable beams A, B, C . . . are raised by the supports 5 so that these supports 5 pivot about their axis of articulation in order to assume the chosen angular position from which the inflatable canopy 1 is deployed. This position may be the horizontal position, as shown in FIG. 4, or a specific angular position, as shown in FIGS. 2 and 13.

The inflatable beams A, B, C . . . are inflated one after the other with the aid of the pressurized-fluid-supply means 4.

The pivoting maneuver of the supports 5 may be obtained by inflation or deflation of at least some of the inflatable beams A, B, C . . . of which the inflatable canopy 1 consists.

Figure 15:
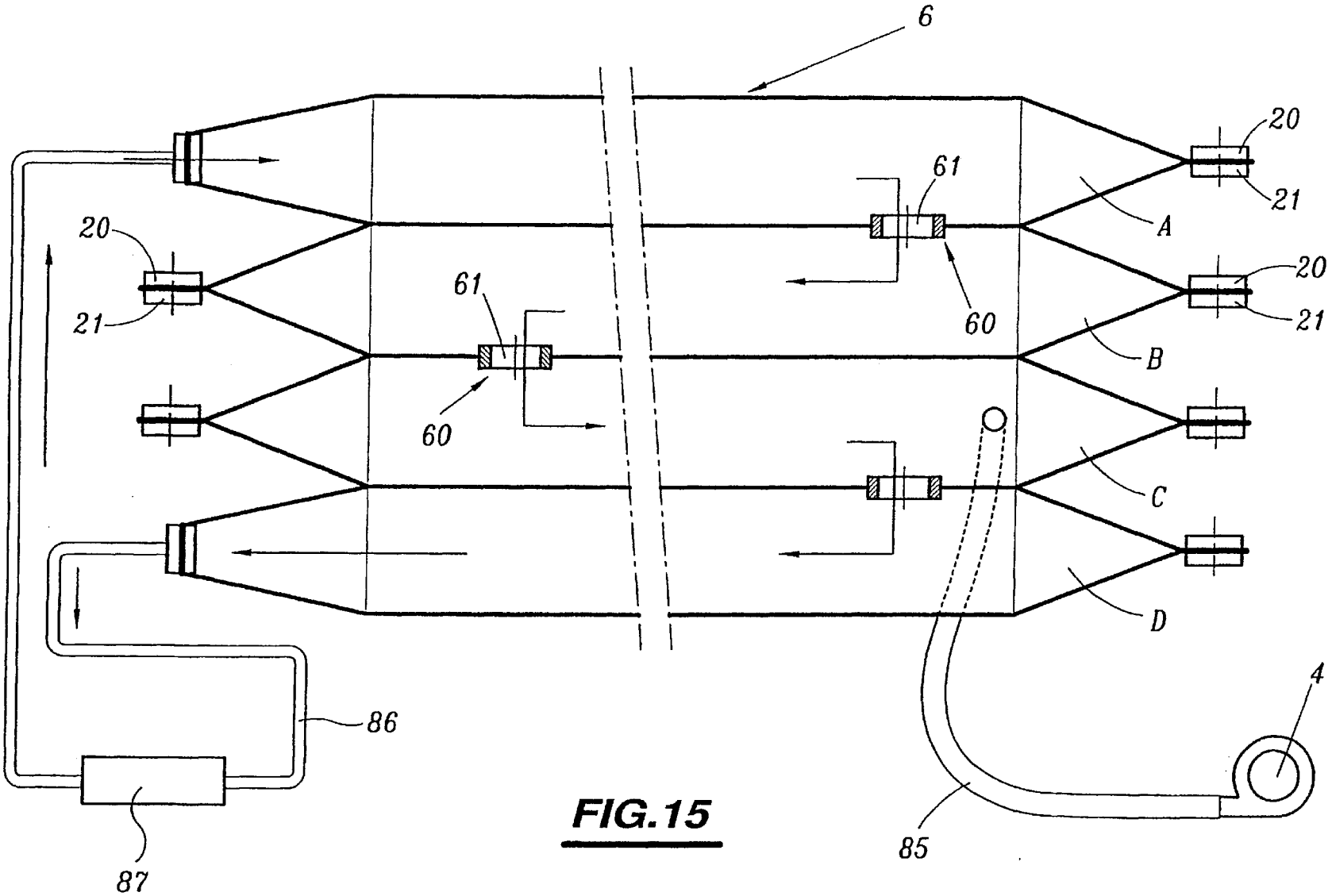
FIG. 15 is a diagrammatic sectional view of an embodiment of the means for supplying the inflatable beams with pressurized fluid.

With reference, now, to FIG. 15, a description will be given of a particular embodiment of the inflatable canopy 1.

In this embodiment, a plurality of inflatable beams A, B, C and D, which are, for example, four in number, placed together, forms a group of inflatable beams whose inner spaces formed by the envelopes 6 communicate together via the intercommunication orifices 61 which are located alternately close to one or other of the ends of the said inflatable beams A, B, C and D.

Each of these intercommunication orifices 61 is in a clamp piece 60, as shown in FIG. 12.

Therefore, each group of beams A, B, C and D is, on the one hand, inflated or deflated successively with the aid of a hose 85 connected up to one of the beams in the corresponding group and connected to the pressurized-fluid-supply means 4.

On the other hand, each group of beams A, B, C and D is connected in closed circuit via a pipe 86 to an installation 87 maintaining the fluid flow at a pressure, temperature and hydrometry which are controlled in order to air-condition the space covered over by the canopy 1, using one or more groups of inflatable beams as a heat exchanger.

According to a further embodiment shown in FIG. 16, the deployment or refolding path 3 comprises at least two pairs of arch-shaped rigid beams 90*a*, 91*a* and 90*b* and 91*b*, respectively.

These rigid beams are parallel to one another and are connected to the foundation or ballasting means 2.

As shown in this figure, the inflatable beams A, B, C . . . are moved by sliding between the rigid beams 90*a*, 91*a* and 90*b* and 91*b* during their inflation or their deflation.

What is claimed is:

1. A canopy comprising:

a plurality of inflatable beams arranged side by side, each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid; and one of a foundation and a ballast connected to at least one of said plurality of inflatable beams, said one of said foundation and said ballast being operable to ballast said plurality of inflatable beams, wherein said plurality of inflatable beams have different lengths such that when said plurality of beams are inflated, said plurality of beams forms an opening between outside and inside of said canopy and longer inflatable beams bear on shorter inflatable beams.

2. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid;

at least one strap connected to said mechanical leaktight confinement device of one of said plurality of inflatable beams; and one of a foundation and a ballast connected to at least said one of said plurality of inflatable beams by said at least one strap, said one of said foundation and said ballast being operable to ballast said plurality of inflatable beams.

3. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid; and one of a foundation and a ballast connected to at least one of said plurality of inflatable beams, said one of said foundation and said ballast being operable to ballast said plurality of inflatable beams, wherein said mechanical leaktight confinement device comprises for each of said two ends, bars connected together by at least one fastening element such that said bars pinch a corresponding end of said tubular envelope, and a seal located in between said bars.

4. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid; and one of a foundation and a ballast connected to at least one of said plurality of inflatable beams, said one of said foundation and said ballast being operable to ballast said plurality of inflatable beams, wherein said mechanical leaktight confinement device comprises for each of said plurality of inflatable beams, a clamp piece connected to said one of said foundation and said ballast, said clamp piece having a first part fastened to an outer face of said tubular envelope, a second part fastened to an inner face of said tubular envelope, at least one fastening element connecting said first part and said second part, and a central orifice communicating, with said pressurized fluid generator via said one of said foundation and said ballast.

5. A canopy as claimed in claim 4, wherein said one of said foundation and said ballast comprises a caisson divided into a plurality of compartments, each of said plurality of compartments communicating with a respective one of said plurality of inflatable beams via the central orifice and with said pressurized fluid generator.

6. A canopy as claimed in claim 4, wherein said one of said foundation and said ballast comprises a caisson communicating with said plurality of inflatable beams via the central orifices and with said pressurized fluid generator, each of the central orifices having a closing-off member operable to be moved between a position in which said cental orifice is open and another position in which the central orifice is closed.

7. A canopy comprising:

a plurality of inflatable beams arranged side by side, wherein each of said plurality of inflatable beams comprises a tubular envelope having two ends and a central orifice, and a mechanical leaktight confinement device operable to close said two ends of said tubular envelope;

a pressurized fluid generator operable to supply said plurality of inflatable beams with pressurized fluid; and one of a foundation and a ballast connected to at least one of said plurality of inflatable beams, said one of said foundation and said ballast being operable to ballast said plurality of inflatable beams, wherein said one of said foundation and said ballast comprises a caisson divided into a plurality of compartments, each of said plurality of compartments communicating with a respective one of said plurality of inflatable beams via the central orifice and with said pressurized fluid generator.

8. A canopy comprising:

a plurality of inflatable beams arranged side by side, wherein each of said plurality of inflatable beams comprises a tubular envelope having two ends and a central orifice, and a mechanical leaktight confinement device operable to close said two ends of said tubular envelope;

a pressurized fluid generator operable to supply said plurality of inflatable beams with pressurized fluid; and one of a foundation and a ballast connected to at least one of said plurality of inflatable beams, said one of said foundation and said ballast being operable to ballast said plurality of inflatable beams, wherein said one of said foundation and said ballast comprises a caisson communicating with said plurality of inflatable beams via the central orifices and with said pressurized fluid generator, each of the central orifices having a closing-off member operable to be moved between a position in which said cental orifice is open and another position in which the central orifice is closed.

9. A canopy as claimed in claim 8, wherein each of said closing off members comprises a rotating butterfly nut associated with an inflatable seal.

10. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid;

one of a foundation and a ballast connected to at least one of said plurality of inflatable beams, said one of said foundation and said ballast being operable to ballast said plurality of inflatable beams; and a linking device for linking said plurality of inflatable beams together, said linking device comprising:

a pair of T-shaped sections located in between each adjacent pair of beams of said plurality of inflatable beams, each of said T-shaped sections having two lateral branches attached to said tubular envelope of a respective one of said adjacent pair of said plurality of inflatable beams, a central branch having a loop at an end opposite to said two lateral branches, and at least one uniformly spaced transverse notch along said T-shaped section, said at least one uniformly spaced transverse notch forming a series of separate flaps in said T-shaped section, and a rod passing through loops of said series of separate flaps of each of said pair of T-shaped sections in an alternating and contiguous manner.

11. A canopy as claimed in claim 10, wherein said linking device is located substantially half-way up radial sections of said tubular envelopes of said plurality of inflatable beams.

12. A canopy as claimed in claim 10, wherein said plurality of inflatable beams are connected together longitudinally via said linking device.

13. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid;

one of a foundation and a ballast connected to at least one of said plurality of inflatable beams, said one of said foundation and said ballast being operable to ballast said plurality of inflatable beams; and a linking device for linking said plurality of inflatable beams together, said linking device comprising:

a fastening fitting located between each adjacent pair of beams of said plurality of inflatable beams, said fastening fitting having first and second parts arranged such that portions of said tubular envelopes of said adjacent pair of beams are located in between said first and second parts, said first and second parts forming a central orifice communicating between inner spaces of said tubular envelopes of each of said adjacent pair of beams.

14. A canopy as claimed in claim 13, wherein the central orifices communicating between inner spaces of said tubular envelopes of said adjacent pairs of beams are on alternating ends of said tubular envelops of each of said adjacent pair of beams.

15. A canopy as claimed in claim 14, further comprising:

a hose connected to one of said plurality of inflatable beams and said pressurized fluid generator, the hose operable to allow for the inflation and deflation of said plurality of inflatable beams; and an installation connected to at least one of said plurality of inflatable beams as a closed circuit, said installation operable to maintain fluid flow at a pressure, a temperature, and a humidity.

16. A canopy as claimed in claim 13, wherein said plurality of inflatable beams are connected together longitudinally via said linking device.

17. A canopy as claimed in claim 13, wherein said linking device is located substantially half-way up radial sections of said tubular envelopes of said plurality of inflatable beams.

18. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid;

one of a foundation and a ballast connected to at least one of said plurality of inflatable beams, said one of said foundation and said ballast being operable to ballast said plurality of inflatable beams; and a deployment/refolding path comprising at least one rigid beam located substantially in a central zone of said plurality of inflatable beams.

19. A canopy as claimed in claim 18, wherein said at least one rigid beam is located outside of said plurality of inflatable beams.

20. A canopy as claimed in claim 19, wherein said at least one rigid beam has a triangular cross section and is formed from an assembly of welded tubes.

21. A canopy as claimed in claim 18, wherein said at least one rigid beam passes through said plurality of inflatable beams in a leaktight manner.

22. A canopy as claimed in claim 21, wherein said at least one rigid beam has a triangular cross section and is formed from an assembly of welded tubes.

23. A canopy as claimed in claim 30, wherein said guiding device comprise a sliding ring secured to the opposite orifices of said adjacent tubular envelops of said plurality of inflatable beams, said sliding ring operable to enter into frictional contact with said at least one rigid beam during deployment or refolding of said plurality of inflatable beams.

24. A canopy as claimed in claim 21, further comprising:

a flexible conduit connecting opposite orifices of adjacent tubular envelops of said plurality of inflatable beams, said flexible conduit being operable to allow said at least one rigid beam to pass through said plurality of inflatable beams in a leaktight manner;

a linking device located at the opposite orifices of said adjacent tubular envelops of said plurality of inflatable beams, said linking device operable to link said adjacent tubular envelopes of said plurality of inflatable beams in a leaktight manner;

a conduit linking device located at the opposite orifices of said adjacent tubular envelops of said plurality of inflatable beams, said conduit linking device operable to link said plurality of inflatable beams with said flexible conduit in a leaktight manner;

a guiding device located at the opposite orifices of said adjacent tubular envelops of said plurality of inflatable beams, said guiding device operable to guide said plurality of inflatable beams along said flexible conduit; and an inner sealing device located at the opposite orifices of said adjacent tubular envelops of said plurality of inflatable beams, said inner sealing device operable to maintain the leaktightness of an inner space of said flexible conduit during deployment or refolding of said plurality of inflatable beams.

25. A canopy as claimed in claim 18, wherein said at least one rigid beam has a triangular cross section and is formed from an assembly of welded tubes.

26. A canopy as claimed in claim 25, further comprising a plurality of curved panels fastened to said at least one rigid beam, said plurality of curved panels giving said at least one rigid beam a circular cross section.

27. A canopy as claimed in claim 26, further comprising a guiding device comprise a sliding ring secured to opposite orifices of adjacent tubular envelops of said plurality of inflatable beams, said sliding ring operable to enter into frictional contact with said at least one rigid beam during deployment or refolding of said plurality of inflatable beams.

28. A canopy as claimed in claim 26, further comprising:

a flexible conduit connecting opposite orifices of adjacent tubular envelops of said plurality of inflatable beams, said flexible conduit being operable to allow said at least one rigid beam to pass through said plurality of inflatable beams in a leaktight manner;

a linking device located at the opposite orifices of said adjacent tubular envelops of said plurality of inflatable beams, said linking device operable to link said adjacent tubular envelopes of said plurality of inflatable beams in a leaktight manner;

a conduit linking device located at the opposite orifices of said adjacent tubular envelops of said plurality of inflatable beams, said conduit linking device operable to link said plurality of inflatable beams with said flexible conduit in a leaktight manner;

a guiding device located at the opposite orifices of said adjacent tubular envelops of said plurality of inflatable beams, said guiding device operable to guide said plurality of inflatable beams along said flexible conduit; and an inner sealing device located at the opposite orifices of said adjacent tubular envelops of said plurality of inflatable beams, said inner sealing device operable to maintain the leaktightness of an inner space of said flexible conduit during deployment or refolding of said plurality of inflatable beams, wherein said inner sealing device comprises an annular seal located at the opposite orifices of said adjacent tubular envelops of said plurality of inflatable beams, said annular seal being in frictional contact with said plurality of curved panels fastened to said at least one rigid beam during deployment or refolding of said plurality of inflatable beams.

29. A canopy as claimed in claim 18, further comprising a plurality of pads located on said tubular envelopes of said plurality of inflatable beams at a point of contact with said deployment/refolding path, said plurality of pads providing a sliding surface and wear reenforcement.

30. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid;

one of a foundation and a ballast connected to at least one of said plurality of inflatable beams, said one of said foundation and said ballast being operable to ballast said plurality of inflatable beams;

a rigid beam passing through said plurality of inflatable beams in a leaktight manner;

a flexible conduit connecting opposite orifices of adjacent tubular envelops of said plurality of inflatable beams, said flexible conduit being operable to allow said rigid beam to pass through said plurality of inflatable beams in a leaktight manner;

a linking device located at the opposite orifices of said adjacent tubular envelops of said plurality of inflatable beams, said linking device operable to link said adjacent tubular envelopes of said plurality of inflatable beams in a leaktight manner;

a conduit linking device located at the opposite orifices of said adjacent tubular envelops of said plurality of inflatable beams, said conduit linking device operable to link said plurality of inflatable beams with said flexible conduit in a leaktight manner;

a guiding device located at the opposite orifices of said adjacent tubular envelops of said plurality of inflatable beams, said guiding device operable to guide said plurality of inflatable beams along said flexible conduit; and an inner sealing device located at the opposite orifices of said adjacent tubular envelops of said plurality of inflatable beams, said inner sealing device operable to maintain the leaktightness of an inner space of said flexible conduit during deployment or refolding of said plurality of inflatable beams.

31. A canopy as claimed in claim 30, wherein said linking device comprises a clamp piece having first and second parts fastened together by at least one fastening element and a seal, said first and second parts pinching together said adjacent tubular envelops of said plurality of inflatable beams and said seal being located in between said adjacent tubular envelops.

32. A canopy as claimed in claim 31, wherein said clamp piece has an annular groove and said conduit linking device comprises a collar having an open ring shape, a tab at each end of said collar, and a fastening element operable to bring said tabs closer to each other causing a corresponding portion of said flexible conduit to grip the annular groove in said clamp piece.

33. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid;

one of a foundation and a ballast connected to at least one of said plurality of inflatable beams, said one of said foundation and said ballast being operable to ballast said plurality of inflatable beams; and a flap located on an inner flange of at least one of said plurality of inflatable beams, said flap extending towards an inside of said canopy.

34. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid;

one of a foundation and a ballast connected to at least one of said plurality of inflatable beams, said one of said foundation and said ballast being operable to ballast said plurality of inflatable beams; and at least one arch-shaped support extending parallel to and in contact with one of said plurality of inflatable beams.

35. A canopy according to claim 34, further comprising a deployment/refolding path comprising at least one rigid beam located substantially in a central zone of said plurality of inflatable beams, wherein said at least one arch-shaped support has a triangular cross section formed by an assembly of welded tubes, and said at least one arch-shaped support is connected to said deployment/refolding path and said one of said foundation and said ballast.

36. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid;

one of a foundation and a ballast connected to at least one of said plurality of inflatable beams, said one of said foundation and said ballast being operable to ballast said plurality of inflatable beams; and a deployment/folding path comprising at least two pairs of arch shaped rigid beams parallel to each other, said at least two pairs of arch shaped rigid beams being connected to said one of said foundation and ballast, wherein said plurality of inflatable beams are slidable in between said at least two pairs of arch shaped rigid beams.

37. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid;

at least one strap connected to said mechanical leaktight confinement device of said plurality of inflatable beams; and one of a foundation and a ballast connected to at least one end of said plurality of inflatable beams via said leaktight confinement device by said at least one strap, said one of said foundation and said ballast being operable to ballast said plurality of inflatable beams.

38. A canopy comprising:

a plurality of inflatable beams arranged side by side, wherein each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid; and one of a foundation and a ballast connected to at least one end of said plurality of inflatable beams via said mechanical leaktight confinement device, said one of said foundation and said ballast being operable to ballast said plurality of inflatable beams, wherein said mechanical leaktight confinement device comprises for each of said plurality of inflatable beams, a clamp piece connected to said one of said foundation and said ballast, said clamp piece having a first part fastened to an outer face of said tubular envelope, a second part fastened to an inner face of said tubular envelope, at least one fastening element connecting said first part and said second part, and a central orifice communicating, with said pressurized fluid generator via said one of said foundation and said ballast.

39. A canopy comprising:

a plurality of inflatable beams arranged side by side, each of said plurality of inflatable beams comprises a tubular envelope having two ends and a mechanical leaktight confinement device operable to close said two ends of said tubular envelope;

a pressurized fluid generator operable to supply said plurality of inflatable beams with pressurized fluid; and one of a foundation and a ballast connected to at least one of said plurality of inflatable beams, said one of said foundation and said ballast being operable to ballast said plurality of inflatable beams, wherein said mechanical leaktight confinement device comprises for each of said two ends of all of said plurality of inflatable beams, two bars connected together by at least one fastening element such that said two bars pinch a corresponding end of said tubular envelope, said two bars being connected to said one of said foundation and said ballast.

* * * * *